US007452263B2

(12) United States Patent
Itoh et al.

(10) Patent No.: US 7,452,263 B2
(45) Date of Patent: Nov. 18, 2008

(54) GRINDING METHOD

(75) Inventors: Yuji Itoh, Toyota (JP); Takashi Noro, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 219 days.

(21) Appl. No.: 10/578,509

(22) PCT Filed: Nov. 16, 2004

(86) PCT No.: PCT/JP2004/016993

§ 371 (c)(1),
(2), (4) Date: May 8, 2006

(87) PCT Pub. No.: WO2005/049270

PCT Pub. Date: Jun. 2, 2005

(65) Prior Publication Data

US 2007/0082584 A1 Apr. 12, 2007

(30) Foreign Application Priority Data

Nov. 19, 2003 (JP) ..... 2003-389181

(51) Int. Cl.
*B24B 49/00* (2006.01)

(52) U.S. Cl. ..... 451/11; 451/49; 451/246

(58) Field of Classification Search ..... 451/41, 451/44, 51, 246, 249, 11, 49
See application file for complete search history.

(56) References Cited

U.S. PATENT DOCUMENTS

| | | | | |
|---|---|---|---|---|
| 5,048,235 | A * | 9/1991 | Smith | 451/72 |
| 5,569,060 | A | 10/1996 | Mori et al. | |
| 5,595,525 | A * | 1/1997 | Hayashi et al. | 451/5 |
| 5,766,059 | A * | 6/1998 | Imai et al. | 451/49 |
| 2005/0095961 | A1 * | 5/2005 | Laycock | 451/57 |

FOREIGN PATENT DOCUMENTS

| | | |
|---|---|---|
| JP | A-06-335716 | 12/1994 |
| JP | A-07-040208 | 2/1995 |
| JP | A-09-253989 | 9/1997 |
| JP | A-2001-191236 | 7/2001 |

* cited by examiner

*Primary Examiner*—Eileen P. Morgan
(74) *Attorney, Agent, or Firm*—Oliff & Berridge, PLC

(57) ABSTRACT

A method of grinding the outer circumferential surface of a workpiece 5 formed of a hard and brittle material into a predetermined shape using a grinding wheel while rotating the workpiece 5 is disclosed. The method includes plunge grinding the workpiece 5 at an arbitrary portion (plunge ground portion 21) in the longitudinal direction of the workpiece 5 by causing the grinding wheel to come in contact with the workpiece 5 in a direction which intersects a rotational axis 8 of the workpiece 5, and traverse grinding the workpiece 5 toward the plunge ground portion 21 by moving the grinding wheel relative to the workpiece 5 in a direction parallel to the rotational axis 8 of the workpiece 5. This allows the outer circumferential surface of the workpiece made of a hard and brittle material, such as a honeycomb structure used for a DPF, to be ground into a predetermined shape in a short time, and prevents occurrence of chipping during grinding.

11 Claims, 8 Drawing Sheets

GRINDING METHOD

TECHNICAL FIELD

The present invention relates to a method of grinding the outer circumferential surface of a workpiece formed of a hard and brittle material.

BACKGROUND ART

A diesel particulate filter (DPF) is provided for a diesel internal combustion engine in order to trap diesel particulate contained in exhaust gas discharged from the engine. A DPF is formed by bonding porous honeycomb segments formed of silicon carbide (SiC) or the like using an adhesive. The outer circumferential surface of the segment bonded body obtained by bonding the honeycomb segments is ground to form a honeycomb structure having an arbitrary shape (e.g. circle or ellipse), and the outer circumferential surface is coated with a coating material.

FIGS. 4 to 6 are views showing the manufacturing steps of a honeycomb structure used for a DPF. As shown in FIG. 4, an original form 1 of a honeycomb structure has a large quadrilateral cross section formed by bonding honeycomb segments 2 having a quadrilateral cross section using an adhesive 3. The original form 1 is held using a holding mechanism 10. The outer circumferential surface of the original form 1 is ground in this state by driving a diamond bead saw 4 in the direction indicated by the arrow B while rotating the original form 1 in the direction indicated by the arrow A to form a honeycomb structure 5 having a circular or oval cross section.

FIG. 5 is a perspective view showing the honeycomb structure 5 ground using the diamond bead saw 4. The honeycomb structure 5 has a shape which is approximately the desired final shape indicated by a broken line 6 and is larger than the final shape to some extent. Therefore, it is necessary to perform finish grinding by grinding the outer circumferential surface to the final shape.

FIG. 6 is a perspective view showing the finish grinding. The honeycomb structure 5 is held by pressing plates 7 made of an elastic material such as rubber toward the ends of the honeycomb structure 5 in the longitudinal direction. The held honeycomb structure 5 is rotated around a rotational axis (rotary shaft) 8 in the direction indicated by the arrow C. A grinding wheel 9 is caused to come in contact with the honeycomb structure 5, as indicated by the arrow E, while being rotated in the direction indicated by the arrow D. The grinding wheel 9 is then moved in the direction indicated by the arrow F to grind the outer circumferential surface of the honeycomb structure 5, whereby the honeycomb structure 5 is formed into the final shape.

The finish grinding is performed by plunge grinding or traverse grinding (including creep-feed grinding). Plunge grinding is a process in which a grinding wheel is caused to come in contact with the honeycomb structure 5 (workpiece) in the direction which intersects the rotational axis 8 of the honeycomb structure 5 at right angles. Traverse grinding is a process in which the honeycomb structure 5 (workpiece) is ground by moving a grinding wheel in the direction parallel to the rotational axis 8 of the honeycomb structure 5.

FIGS. 7 and 9 are views showing plunge grinding, and FIG. 10 is a view showing traverse grinding.

Plunge grinding shown in FIG. 7 generally utilizes a profile grinding wheel. In this case, a grinding wheel having a width greater than the length of the honeycomb structure 5 to some extent is used as a grinding wheel 11. As shown in FIGS. 7(*a*) to 7(*c*), the profile grinding wheel 11 is caused to come in contact with the honeycomb structure 5 while rotating the profile grinding wheel 11, and the profile grinding wheel 11 is removed when the honeycomb structure 5 has been ground to a predetermined outer diameter to finish the process.

When using the profile grinding wheel 11, while the processing (working) time is reduced since the entire honeycomb structure 5 is ground, the large grinding wheel 11 is very expensive. Moreover, since the honeycomb structure 5 is formed of hard SiC, the grinding wheel 11 is worn away to a large extent. This makes it necessary to frequently dress the grinding wheel 11, whereby the shape management becomes complicated.

FIG. 8 is a view showing the grinding wheel 11 after the grinding process has been completed. Since the honeycomb structure 5 always contacts the same portion of the grinding wheel 11, the grinding wheel 11 is worn away approximately in a wear portion 11*a*. Since the wear portion 11*a* contacts the honeycomb structure 5, the honeycomb structure 5 cannot be precisely ground.

Therefore, a flat grinding wheel 12 shown in FIG. 9 is used in plunge grinding. The flat grinding wheel 12 has a width smaller than the length of the honeycomb structure 5 (workpiece). As shown in FIG. 9(*a*), the grinding wheel 12 is caused to come in contact with the honeycomb structure 5 in the direction which intersects the rotational axis 8 of the honeycomb structure 5 at right angles while rotating the grinding wheel 12 and the honeycomb structure 5. The grinding wheel 12 is caused to come in contact with one end 5*a* of the honeycomb structure 5 in the longitudinal direction.

When the outer diameter of one end 5*a* (cut portion) of the honeycomb structure 5 has been reduced to a predetermined value, the grinding wheel 12 is removed, as shown in FIG. 9(*b*). After moving the grinding wheel 12 in the longitudinal direction (horizontal direction) of the honeycomb structure 5 to some extent, as shown in FIG. 9(*c*), the grinding wheel 12 is caused to again come in contact with the honeycomb structure 5, as shown in FIG. 9(*d*). The above-described operation (i.e. cutting, removal, and movement) of the grinding wheel 12 is repeatedly performed a number of times from one end 5*a* to the other end 5*b* of the honeycomb structure 5 to reduce the outer diameter of the honeycomb structure 5 to a predetermined value.

FIG. 10 is a view showing traverse grinding, in which a flat grinding wheel is used as the grinding wheel 12 in the same manner as in plunge grinding shown in FIG. 9. In traverse grinding, the grinding wheel 12 is caused to come in contact with the honeycomb structure 5 in the horizontal direction. The outer surface of the honeycomb structure 5 is ground by moving the grinding wheel 12 from one end to the other end 5*b* of the honeycomb structure 5 in the direction parallel to the rotational axis 8 of the honeycomb structure 5.

DISCLOSURE OF THE INVENTION

In plunge grinding shown in FIG. 9, since cutting, removal, and movement of the grinding wheel 12 must be repeatedly performed a number of times, the processing time is increased to a large extent, whereby the productivity is decreased. Moreover, since the same portion of the grinding wheel 12 contacts the honeycomb structure 5 during cutting, this portion is worn away to a large extent, whereby the processed surface of the honeycomb structure 5 may be impaired.

In traverse grinding shown in FIG. 10, while the processing time is reduced, the edge of the honeycomb structure 5 breaks (chipping) when completing grinding.

FIG. 11 is a view showing a chipping mechanism. FIG. 11 is an enlarged cross-sectional view of the portion H shown in FIG. 10(*c*). In the final stage of moving the grinding wheel 12 in the longitudinal direction of the honeycomb structure 5, when a shearing force in the traveling direction of the grinding wheel 12 exceeds the strength of the honeycomb structure 5, a portion of the other end 5*b* of the honeycomb structure 5 is separated from the remaining portion to produce a chip 13. This causes a breakage 14 to occur on the other end 5*b* of the honeycomb structure 5. Since such chipping results in a defective product, the yield is decreased.

FIGS. 12 and 13 are views showing known methods for preventing occurrence of chipping.

The method shown in FIG. 12 reduces the amount of cutting "J" of the grinding wheel 12. Specifically, grinding is controlled so that the amount of the honeycomb structure 5 ground by the grinding wheel 12 is reduced. The size of the chip 13 removed from the honeycomb structure 5 is reduced by reducing the amount of cutting "J", whereby the breakage 14 occurring on the other end 5*b* of the honeycomb structure 5 can be reduced. However, the method shown in FIG. 12 has a problem in which the number of cutting operations until the honeycomb structure 5 has a desired outer diameter is increased, whereby the processing time is increased.

The method shown in FIG. 13 utilizes a dummy material 16. The dummy material 16 is formed of the same material as that of the honeycomb structure 5 and has the same structure as that of the honeycomb structure 5. The dummy material 16 is ground in a state in which the dummy material 16 is attached to the end face of the honeycomb structure 5 on the other end. The dummy material 16 has a diameter larger than the desired diameter of the honeycomb structure 5 (see FIG. 13(*a*)) so that the grinding wheel 12 cuts the dummy material 16 when the grinding wheel 12 which grinds the honeycomb structure 5 has reached the other end 5*b* (see FIG. 13(*b*)). When the grinding wheel 12 has reached the free end of the dummy material 16, a breakage 17 occurs in the dummy material 16. This prevents a breakage from occurring in the honeycomb structure 5.

However, since the method shown in FIG. 13 involves attaching the dummy material 16 to the end face of the honeycomb structure 5 and removing the dummy material 16 from the end face, the number of steps is increased. Moreover, it is difficult to attach the dummy material 16 when the end face of the honeycomb structure 5 is nonuniform, whereby workability is decreased.

The present invention was achieved in view of the above-described problems. An object of the present invention is to provide a grinding method which can reduce the processing time of a workpiece formed of a hard and brittle material and can prevent a breakage on the end of the workpiece without requiring a complicated operation. As a result of extensive studies, it was found that the above object can be achieved by the following means.

According to the present invention, there is provided a method of grinding an outer circumferential surface of a workpiece formed of a hard and brittle material into a predetermined shape using a grinding wheel while rotating the workpiece, the method comprising plunge grinding the workpiece at an arbitrary portion in a longitudinal direction of the workpiece by causing the grinding wheel to come in contact with the workpiece in a direction which intersects a rotational axis of the workpiece, and traverse grinding the workpiece toward the plunge ground portion by moving the grinding wheel relative to the workpiece in a direction parallel to the rotational axis of the workpiece (hereinafter may be called "first grinding method").

In the first grinding method of the present invention, the outer circumferential surface of the workpiece is ground into a predetermined final shape by plunge grinding the workpiece at an arbitrary portion in the longitudinal direction, and traverse grinding the workpiece by moving the grinding wheel toward the plunge ground portion. Since only a portion of the workpiece is plunge ground, and the major portion of the workpiece in the longitudinal direction is traverse ground, the processing time can be reduced. In the final stage of traverse grinding, since the grinding wheel reaches the plunge ground portion which has been ground into a predetermined shape, chipping does not occur. Therefore, breakage of the workpiece due to chipping does not occur. This makes a complicated chipping prevention operation unnecessary, whereby the processability can be improved.

In the first grinding method of the present invention, it is preferable to perform the plunge grinding for at least one end of the workpiece in the longitudinal direction. According to this preferable feature, since one end of the workpiece is plunge ground, it suffices to move the grinding wheel in one direction toward one end of the workpiece during traverse grinding, whereby the operability of the grinding wheel can be improved.

In the first grinding method of the present invention, it is preferable to perform the plunge grinding for a middle portion of the workpiece in the longitudinal direction. According to this preferable feature, since the middle portion of the workpiece is plunge ground, and traverse grinding is performed toward the plunge ground portion in the middle portion, the operability of the grinding wheel can be improved.

According to the present invention, there is provided a method of grinding an outer circumferential surface of a workpiece formed of a hard and brittle material into a predetermined shape using a grinding wheel while rotating the workpiece, the method comprising traverse grinding the workpiece from one end to a middle portion in a longitudinal direction of the workpiece by moving the grinding wheel relative to the workpiece in a direction parallel to a rotational axis of the workpiece, and traverse grinding the workpiece from the other end to the middle portion of the workpiece in the longitudinal direction (hereinafter may be called "second grinding method"). Note that the term "grinding method of the present invention" used herein refers to both the first grinding method and the second grinding method.

In the second grinding method of the present invention, since the first-stage traverse grinding is performed until the middle portion of the workpiece is reached, and the second-stage traverse grinding is performed toward the middle portion, plunge grinding is made unnecessary, whereby the processing time can be reduced. Moreover, since the grinding wheel reaches the middle portion which has been ground into a predetermined shape in the final stage of the second-stage traverse grinding, chipping does not occur. Therefore, breakage of the workpiece due to chipping does not occur. This makes a complicated chipping prevention operation unnecessary, whereby the processability can be improved.

The first grinding method and the second grinding method of the present invention are suitably applied when the workpiece is a honeycomb structure used for a diesel particulate filter. Specifically, when the workpiece is a honeycomb structure used for a diesel particulate filter, the honeycomb structure can be ground in a short time without causing chipping to occur. This increases the productivity and yield of the honeycomb structure.

In the first grinding method and the second grinding method of the present invention, it is preferable to perform the plunge grinding and the traverse grinding in dry air while setting the rotational speed of the grinding wheel to 100 m/sec or more. The grinding speed can be improved by reducing wear of the grinding wheel by grinding the workpiece while setting the rotational speed of the grinding wheel to 100 m/sec or more.

According to the first grinding method of the present invention, since the major portion of the workpiece in the longitudinal direction is processed by traverse grinding, the processing time can be reduced. Moreover, since the grinding wheel reaches the plunge ground portion, which has been ground into a predetermined shape, in the final stage of traverse grinding, chipping does not occur. This makes a complicated chipping prevention operation unnecessary, whereby the processability can be improved.

According to the preferable feature of the first grinding method of the present invention, since the grinding wheel is moved in one direction toward one end of the workpiece, the operability of the grinding wheel is further improved.

According to the preferable feature of the first grinding method of the present invention, since traverse grinding is performed by moving the grinding wheel toward the plunge ground portion in the middle portion, the operability of the grinding wheel can be improved.

According to the second grinding method of the present invention, since plunge grinding is made unnecessary, the processing time can be reduced. Moreover, since the grinding wheel reaches the middle portion, which has been ground into a predetermined shape, in the second-stage traverse grinding, chipping does not occur. This makes a complicated chipping prevention operation unnecessary, whereby the processability can be improved.

According to the first grinding method and the second grinding method of the present invention, a honeycomb structure used for a diesel particulate filter can be ground in a short time without causing chipping to occur, whereby the productivity and yield of the honeycomb structure can be improved.

According to the first grinding method and the second grinding method of the present invention, the lifetime of the grinding wheel is increased, whereby productivity can be further improved.

EXPLANATION OF REFERENCE NUMERALS

Figures 1A, 1B, 1C, 1D:
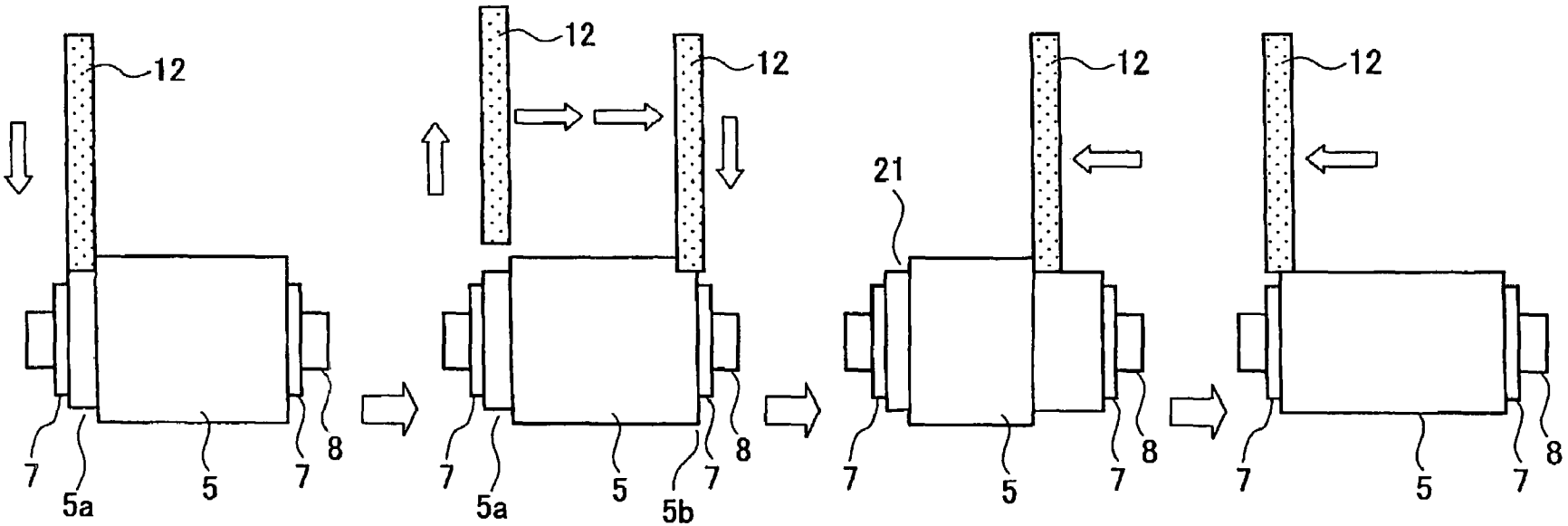
FIG. 1 is a front view showing a grinding process according to a first embodiment of a grinding method of the present invention.

5 . . . honeycomb structure, 5*a* . . . one end, 5*b* . . . the other end,

8 . . . rotational axis, 12,22 . . . grinding wheel,

21 . . . plunge ground portion

BEST MODE FOR CARRYING OUT THE INVENTION

Embodiments of the present invention are described below with reference to the drawings. Note that the present invention is not limited to the following embodiments. Various alterations, modifications, and improvements may be made in the embodiments within the scope of the invention based on knowledge of a person skilled in the art. Although the drawings represent preferred embodiments of the present invention, the present invention is not limited to the modes illustrated in the drawings or the information given in the drawings. Although the present invention may be practiced or verified by applying means similar to or equivalent to means described herein, preferred means is the means described herein.

The embodiments described below in detail illustrate the case of applying the present invention to a honeycomb structure used for a diesel particulate filter as a grinding target workpiece.

The honeycomb structure as the workpiece is manufactured as described below, for example. A ceramic such as SiC, silicon nitride, cordierite, alumina, mullite, zirconia, zirconium phosphate, aluminum titanate, titania, or a mixture thereof, an FE—Cr—Al metal, an Ni-based metal, Si, SiC, and the like are used as the raw material. A binder such as methylcellulose or hydroxypropoxyl methylcellulose, a surfactant, water, and the like are added to the raw material to obtain plastic clay.

The clay is extruded to obtain a formed product having a number of through-holes partitioned by walls. The formed product is dried using microwaves, hot air, or the like, and then fired to obtain a honeycomb segment having a quadrilateral cross section.

Figure 4:
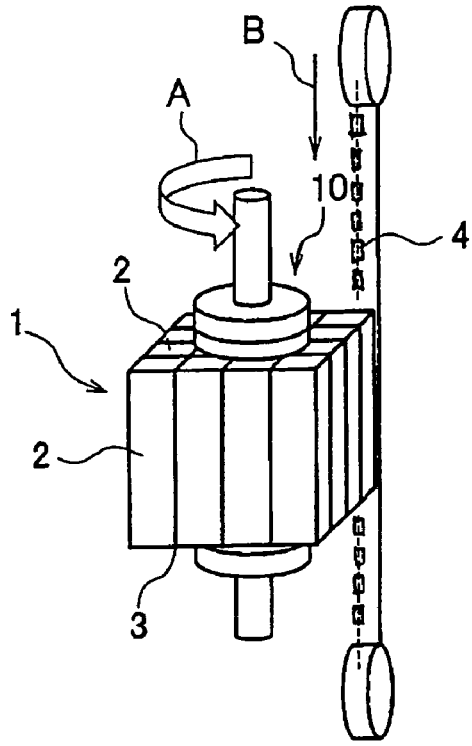
FIG. 4 is a perspective view showing the state of grinding an original form of a honeycomb structure.

The honeycomb segments are bonded using an adhesive to obtain the original form 1 of a honeycomb structure having a large quadrilateral cross section shown in FIG. 4. As the adhesive, a material prepared by adding an inorganic fiber such as a ceramic fiber, an organic or inorganic binder, and a dispersion medium such as water to ceramic powder used for the honeycomb segments may be used.

Figure 5:
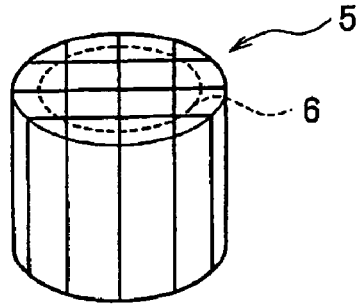
FIG. 5 is a perspective view of a honeycomb structure processed as shown in FIG. 4.
Figure 6:
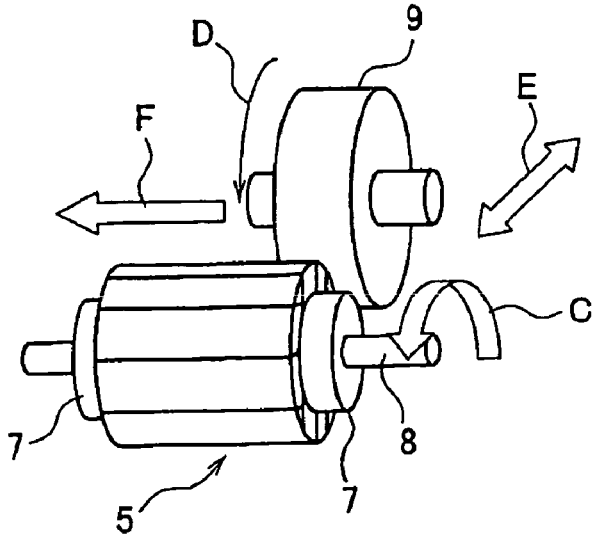
FIG. 6 is a perspective view showing the state of final grinding the outer circumferential surface of a honeycomb structure using a known method.
Figure 7A:
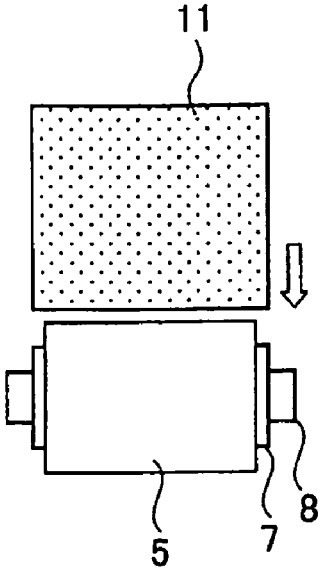
FIG. 7 is a front view showing a plunge grinding process by a known method using a profile grinding wheel.
Figure 7B:
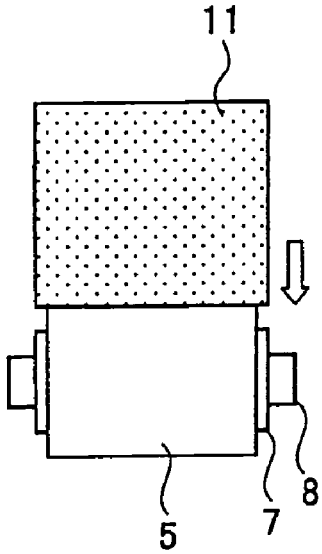
Figure 7C:
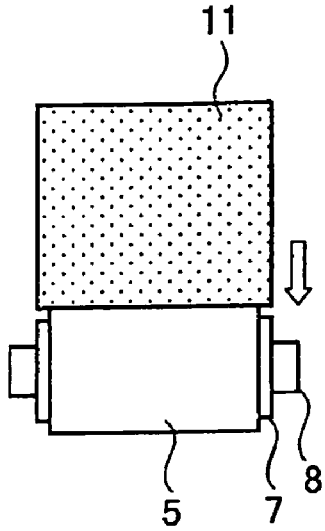
Figure 8:
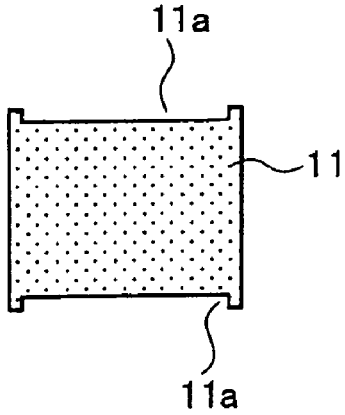
FIG. 8 is a front view showing a disadvantage of a known method when using a profile grinding wheel.
Figures 9A, 9B, 9C, 9D:
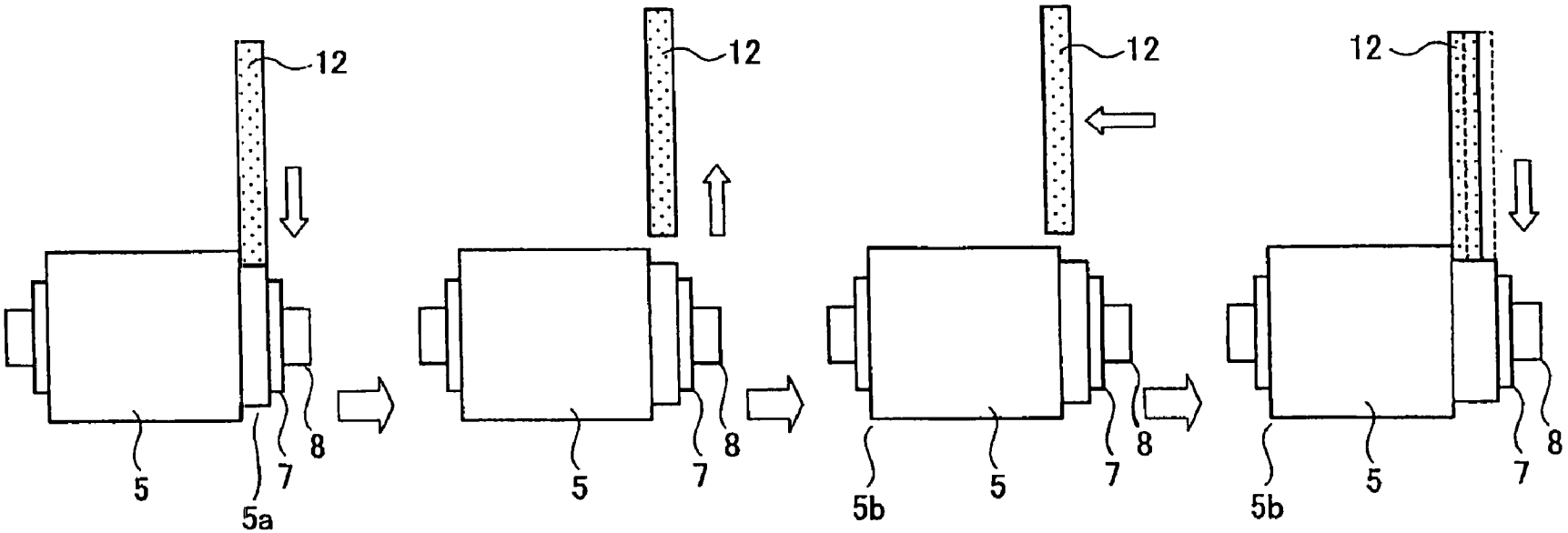
FIG. 9 is a front view showing a known plunge grinding process.
Figure 10A:
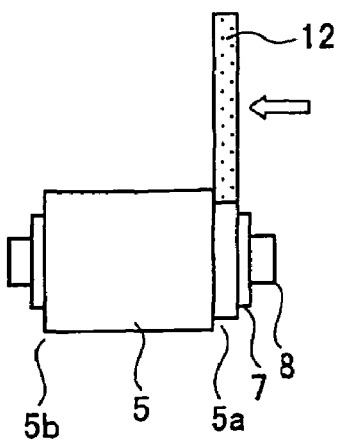
FIG. 10 is a front view showing a known traverse grinding process.
Figure 10B:
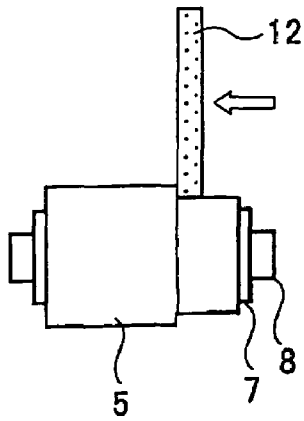
Figure 10C:
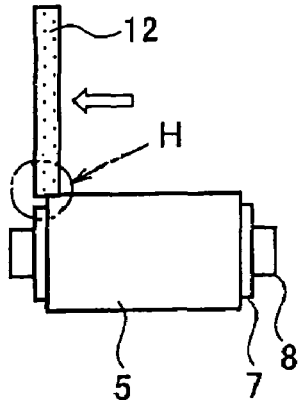
Figure 11A:
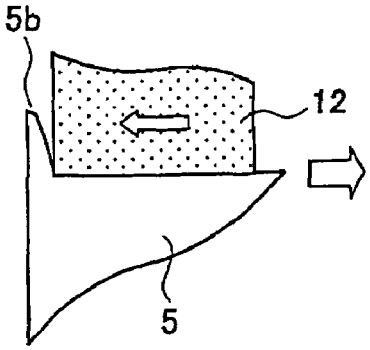
FIG. 11 is a front view showing a chipping mechanism.
Figure 11B:
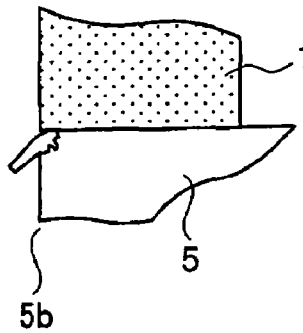
Figure 11C:
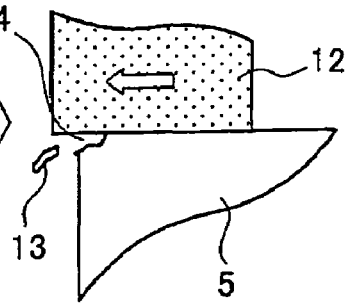
Figure 12A:
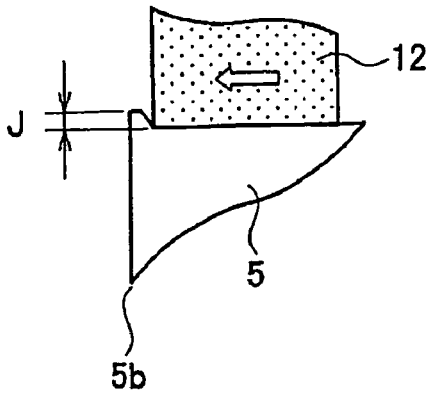
FIG. 12 is a front view showing a known method for preventing occurrence of chipping.
Figure 12B:
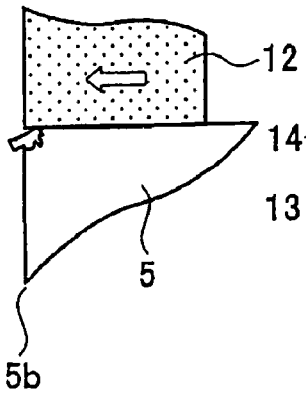
Figure 12C:
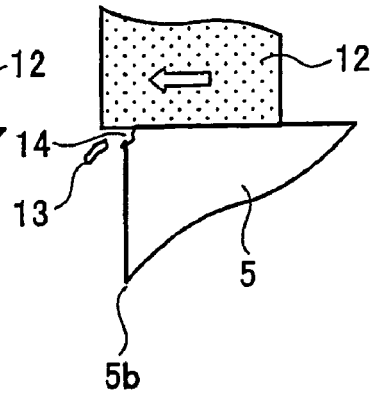
Figure 13A:
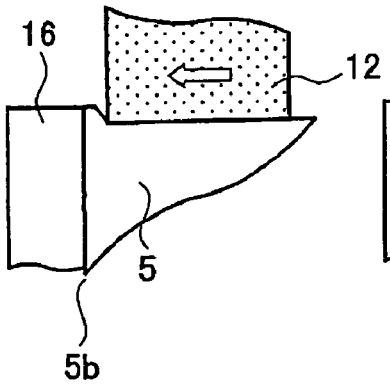
FIG. 13 is a front view showing another known method for preventing occurrence of chipping.
Figure 13B:
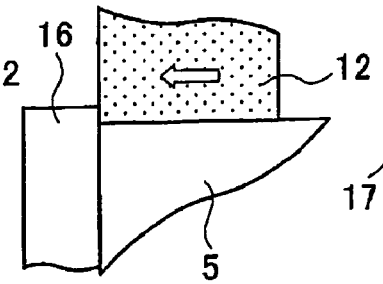
Figure 13C:
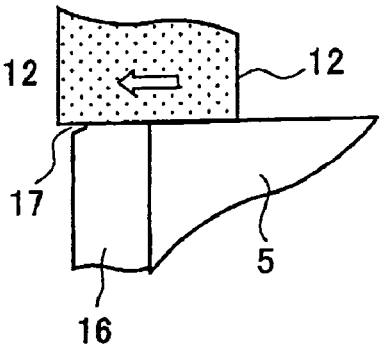

The outer circumferential surface of the original form 1 is ground using the diamond bead saw 4 shown in FIG. 4 to obtain the honeycomb structure 5 having a circular cross section (see FIG. 5). In the present invention, the resulting honeycomb structure 5 is ground to a predetermined final shape.

FIG. 1 is a view showing a grinding process according to a first embodiment of the grinding method of the present invention. The ends of the honeycomb structure 5 (workpiece) in the longitudinal direction are held using the pressing plates 7 formed of an elastic material such as rubber. The pressing plate 7 is attached to the rotational axis (rotary shaft) 8 connected with a motor (not shown). The honeycomb structure 5 is rotated during grinding due to rotation of the rotational axis 8.

As the grinding wheel 12, a flat grinding wheel having a width smaller than the length of the honeycomb structure 5 is used. The grinding wheel 12 is caused to come in contact with the honeycomb structure 5 while being rotated to grind the honeycomb structure 5.

In the first embodiment shown in FIG. 1, plunge grinding and traverse grinding are performed in combination, with the traverse grinding being performed after the plunge grinding.

In plunge grinding, as shown in FIG. 1(*a*), the grinding wheel 12 is caused to approach one end 5*a* of the honeycomb structure 5 and come in contact with the honeycomb structure 5 in the direction which intersects the rotational axis 8 at right angles. The amount of cutting is controlled so that the honeycomb structure 5 has a desired diameter. A plunge ground portion 21 is formed by cutting on one end 5*a* of the honeycomb structure 5.

After cutting one end 5*a*, the grinding wheel 12 is removed from the honeycomb structure 5, as shown in FIG. 1(*b*). The grinding wheel 12 is then moved in parallel to the honeycomb structure 5 and positioned on the other end 5*b* of the honeycomb structure 5, and traverse grinding is performed from the other end 5*b*.

In traverse grinding, as shown in FIG. 1(*c*), the grinding wheel 12 is caused to come in contact with the other end 5*b* of the honeycomb structure 5 and is moved in the direction parallel to the rotational axis 8, as indicated by the arrow, to grind the honeycomb structure 5. Specifically, the grinding wheel 12 is moved toward the plunge ground portion 21. Traverse grinding is controlled so that the amount of cutting is equal to the amount of cutting in the above-described plunge grinding. The grinding wheel 12 is moved to reach the plunge ground portion 21 formed on one end 5*a* of the honeycomb structure 5. This allows the outer circumferential surface of the entire honeycomb structure to be processed to a desired diameter.

In the first embodiment, since plunge grinding is performed for one end 5*a* of the honeycomb structure 5, only a portion of the honeycomb structure 5 is ground by plunge grinding. Since the remaining portion of the honeycomb structure 5 is ground by traverse grinding, the processing time can be reduced.

In the final stage of traverse grinding, since the grinding wheel 12 reaches the plunge ground portion 21 which has been formed in a predetermined shape, a shearing force due to the grinding wheel 12 does not act on the honeycomb structure 5. This prevents occurrence of chipping, whereby a breakage due to chipping does not occur. This makes a complicated chipping prevention operation unnecessary, whereby the processability can be improved.

Figures 2A, 2B, 2C, 2D:
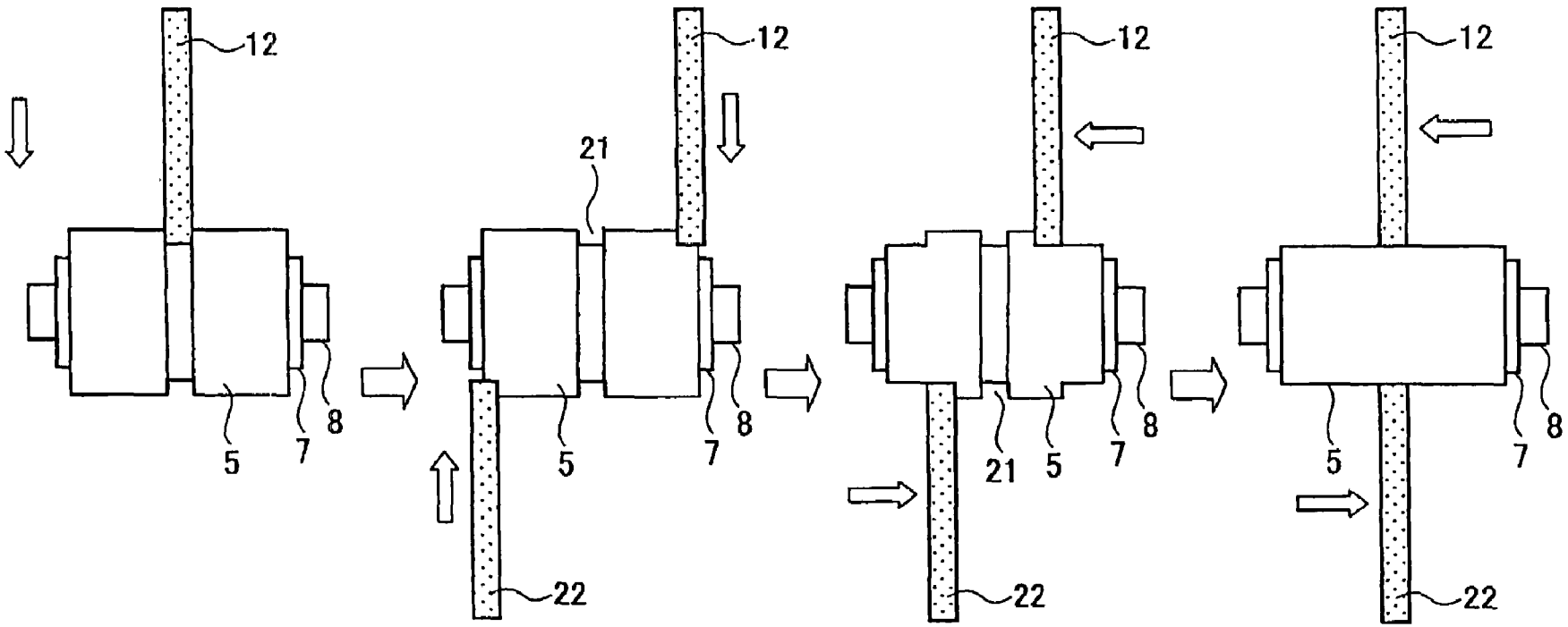
FIG. 2 is a front view showing a grinding process according to a second embodiment of a grinding method of the present invention.

FIG. 2 is a view showing a grinding process according to a second embodiment of the grinding method of the present invention. In the second embodiment, plunge grinding is performed for the middle portion (approximately the center) of the honeycomb structure 5 in the longitudinal direction. Specifically, as shown in FIG. 2(*a*), the grinding wheel 12 is caused to come in contact with the middle portion of the honeycomb structure 5 in the longitudinal direction to form the plunge ground portion 21. Traverse grinding is performed after plunge grinding.

Traverse grinding utilizes two grinding wheels 12 and 22, as shown in FIG. 2(*b*). Traverse grinding is performed by moving the grinding wheels 12 and 22 from the ends of the honeycomb structure 5 in the direction parallel to the rotational axis 8. Specifically, the grinding wheels 12 and 22 are moved toward the plunge ground portion 21 in the middle portion so that the grinding wheels 12 and 22 approach, as indicated by the arrows shown in FIG. 2(*c*). The outer circumferential surface of the entire honeycomb structure 5 is ground to a desired diameter by moving the grinding wheels 12 and 22 toward the plunge ground portion 21.

According to the second embodiment, the honeycomb structure 5 can be ground in a short time in the same manner as in the first embodiment. Moreover, since chipping does not occur, a complicated chipping prevention operation is not required, whereby the processability can be improved. In particular, the second embodiment has an advantage in that the time required for traverse grinding can be reduced since two grinding wheels 12 and 22 are used during traverse grinding.

Figures 3A, 3B, 3C, 3D:
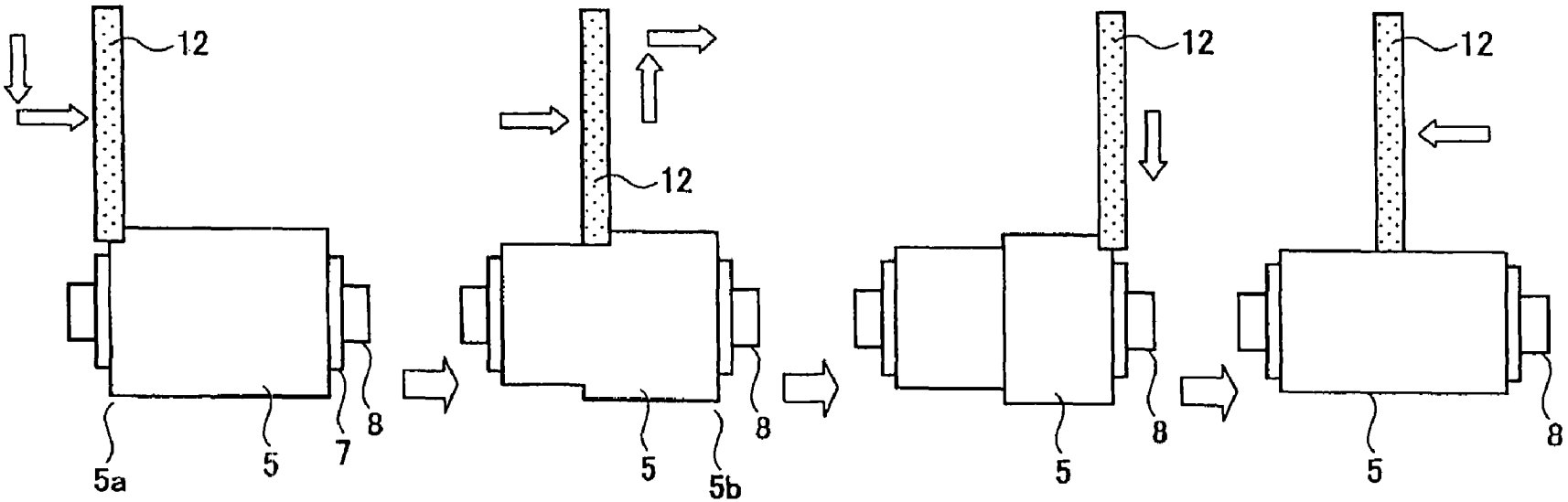
FIG. 3 is a front view showing a grinding process according to a third embodiment of a grinding method of the present invention.

FIG. 3 is a view showing a grinding process according to a third embodiment of the grinding method of the present invention. In the third embodiment, two-stage traverse grinding is performed for the honeycomb structure 5.

Specifically, in the first-stage traverse grinding, as shown in FIG. 3(*a*), the grinding wheel 12 is caused to come in contact with one end 5*a* of the honeycomb structure 5 in the longitudinal direction, and is moved in the direction parallel to the rotational axis 8. The grinding wheel 12 is stopped when the grinding wheel 12 has reached the middle portion of the honeycomb structure 5 in the longitudinal direction. As shown in FIG. 3(*b*), the grinding wheel 12 is removed from the honeycomb structure 5 when the grinding wheel 12 has reached the middle portion of the honeycomb structure 5. The grinding wheel 12 is then moved toward the other end 5*b* of the honeycomb structure 5.

FIG. 3(*c*) shows the second-stage traverse grinding. The grinding wheel 12 is caused to come in contact with the other end 5*b* of the honeycomb structure 5, and is moved in the direction parallel to the rotational axis 8. In this case, the grinding wheel 12 is moved in the direction opposite to the direction in the first-stage traverse grinding. The process is terminated when the grinding wheel 12 has reached the portion at which the first-stage traverse grinding was terminated. This allows the outer circumferential surface of the entire honeycomb structure to be ground to a desired diameter. In the final stage of the two-stage traverse grinding, since the grinding wheel 12 reaches the middle portion which has been ground to a predetermined shape, occurrence of chipping is prevented.

According to the third embodiment, since the process is completed by the first-stage and second-stage traverse grinding without requiring plunge grinding, the processing time can be reduced. Moreover, since chipping does not occur in the final stage of the second-stage traverse grinding, a complicated chipping prevention operation is made unnecessary, whereby the processability can be improved.

Table 1 shows qualitative comparison among the above-described embodiments and known grinding methods. A method "A" corresponds to the method according to the first embodiment, a method "B" corresponds to the method according to the second embodiment, and a method "C" corresponds to the method according to the third embodiment. The value shown in Table 1 indicates the ratio with respect to known plunge grinding ("1"). The methods "A" to "C" have advantages over the known grinding methods.

TABLE 1

| | Known plunge grinding | Known traverse grinding: Normal traverse grinding | Known traverse grinding: When the amount of cutting was reduced | Known traverse grinding: When dummy material was attached | Embodiment: Method A | Embodiment: Method B | Embodiment: Method C |
|---|---|---|---|---|---|---|---|
| Processing time | 1 | 0.25 | 1.2 | 0.25 | 0.4 | 0.4 | 0.4 |
| Lifetime of grinding wheel | 1 | 1.4 | 1.4 | 1.4 | 1.5 | 1.5 | 1.5 |
| Number of steps | 1 | 1 | 1 | 3 | 1 | 1 | 1 |
| Chipping | None | Occurred | Occurred (small) | None | None | None | None |

In the first to third embodiments, plunge grinding and traverse grinding are preferably performed in dry air while setting the rotational speed of the grinding wheel 12 (22) to 100 m/sec or more.

According to this configuration, the grinding speed can be increased by reducing wear of the grinding wheel by grinding the honeycomb structure while setting the rotational speed of the grinding wheel 12 (22) to 100 m/sec or more. This increases the lifetime of the grinding wheel, whereby the productivity can be increased.

The present invention is not limited to the above-described embodiments. Various modifications and variations may be made. For example, it suffices that the grinding target workpiece be formed of a hard and brittle material. As the material for the workpiece, a ceramic porous material or the like may be used. The workpiece may be ground to a non-circular shape such as an ellipse, fan, or triangle. In this case, the workpiece can be ground by numerical control.

INDUSTRIAL APPLICABILITY

The grinding method of the present invention is useful as a means for grinding a workpiece formed of a hard and brittle material. In particular, the grinding method of the present invention is suitably applied when the workpiece is a honeycomb structure used for a diesel particulate filter.

The invention claimed is:

1. A method of grinding an outer circumferential surface of a workpiece formed of a hard and brittle material into a predetermined shape using a grinding wheel while rotating the workpiece, the method comprising:

plunge grinding the workpiece in dry air at an arbitrary portion in a longitudinal direction of the workpiece by causing the grinding wheel to come in contact with the workpiece in a direction which intersects a rotational axis of the workpiece; and traverse grinding the workpiece in dry air toward the plunge ground portion by moving the grinding wheel relative to the workpiece in a direction parallel to the rotational axis of the workpiece, wherein in the traverse grinding step, the grinding wheel moves only in a direction toward the plunge ground portion while traverse-grinding the workpiece to a final shape.

2. The method according to claim 1, wherein the plunge grinding is performed for at least one end of the workpiece in the longitudinal direction.

3. The method according to claim 1, wherein the plunge grinding is performed for a middle portion of the workpiece in the longitudinal direction.

4. The method according to claim 1, wherein the workpiece is a honeycomb structure used for a diesel particulate filter.

5. The method according to claim 1, wherein the plunge grinding and the traverse grinding are performed in dry air while setting a rotational speed of the grinding wheel to 100 m/sec or more.

6. The method according to claim 1, wherein the traverse grinding step is started only after the plunge grinding step is completed, and the plunge ground portion is not processed again after the traverse grinding step has started.

7. A method of grinding an outer circumferential surface of a workpiece formed of a hard and brittle material into a predetermined shape using a grinding wheel while rotating the workpiece, the method comprising:

traverse grinding the workpiece from one end to a middle portion in a longitudinal direction of the workpiece by moving the grinding wheel relative to the workpiece in a direction parallel to a rotational axis of the workpiece; and traverse grinding the workpiece from the other end to the middle portion of the workpiece in the longitudinal direction, wherein in the traverse grinding steps, the grinding wheel only moves toward the middle portion while traverse-grinding the workpiece to a final shape.

8. The method according to claim 7, wherein the workpiece is a honeycomb structure used for a diesel particulate filter.

9. The method according to claim 7, wherein the plunge grinding and the traverse grinding are performed in dry air while setting a rotational speed of the grinding wheel to 100 m/sec or more.

10. The method according to claim 7, wherein the second traverse grinding step starts only after the first traverse grinding step is completed and the portion processed by the first traverse grinding step is not reprocessed after the second traverse grinding step has started.

11. The method according to claim 7, wherein, in the traverse grinding steps, the grinding wheel comes in contact with one end of the workpiece and grinds the one end to a predetermined depth.

* * * * *